US012593901B2

(12) United States Patent
Zhong

(10) Patent No.: US 12,593,901 B2
(45) Date of Patent: Apr. 7, 2026

(54) FOLDABLE CRUTCH STOOL

(71) Applicant: HongKong Pishon Medical Equipment Co., Limited, Hong Kong (CN)

(72) Inventor: Qiu Zhong, Shenzhen (CN)

(73) Assignee: HongKong Pishon Medical Equipment Co., Limited, Hong Kong (CN)

( * ) Notice: Subject to any disclaimer, the term of this patent is extended or adjusted under 35 U.S.C. 154(b) by 0 days.

(21) Appl. No.: 19/217,088

(22) Filed: May 23, 2025

(65) Prior Publication Data

US 2025/0280931 A1 Sep. 11, 2025

(51) Int. Cl.

| | |
|---|---|
| ***A45B 5/00*** | (2006.01) |
| ***A45B 9/02*** | (2006.01) |
| ***A47C 4/04*** | (2006.01) |
| ***A47C 9/10*** | (2006.01) |
| ***A47C 13/00*** | (2006.01) |

(52) U.S. Cl.

CPC ..... *A45B 5/00* (2013.01); *A45B 9/02* (2013.01); *A47C 4/04* (2013.01); *A47C 9/10* (2013.01); *A47C 9/105* (2013.01); *A47C 13/00* (2013.01)

(58) Field of Classification Search

CPC ..... A45B 5/00

USPC ..... 135/66; 297/16.2

See application file for complete search history.

(56) References Cited

U.S. PATENT DOCUMENTS

| | | | | |
|---|---|---|---|---|
| 2,002,118 | A * | 5/1935 | Johnson | A45B 5/00 297/118 |
| 2,649,140 | A * | 8/1953 | Housel | A45B 5/00 248/431 |
| 9,357,820 | B2 * | 6/2016 | Pao | A45B 5/00 |
| 9,414,655 | B2 * | 8/2016 | Pao | A45B 5/00 |
| 9,504,297 | B2 * | 11/2016 | Pao | A47C 4/04 |
| 9,681,713 | B2 * | 6/2017 | Pao | A45B 5/00 |
| 11,432,651 | B2 * | 9/2022 | Pao | A45B 5/00 |
| 11,700,946 | B2 * | 7/2023 | Pao | A47C 9/105 297/16.2 |
| 12,127,647 | B2 * | 10/2024 | Lee | A45B 5/00 |
| D1,071,534 | S * | 4/2025 | Li | D3/7 |
| 2013/0125943 | A1 * | 5/2013 | Hung | A45B 9/00 135/75 |
| 2014/0034097 | A1 * | 2/2014 | Pao | A45B 5/00 135/66 |
| 2015/0107636 | A1 * | 4/2015 | Pao | A45B 5/00 135/66 |
| 2015/0196103 | A1 * | 7/2015 | Pao | A47C 9/105 297/55 |
| 2015/0265012 | A1 * | 9/2015 | Pao | A45B 5/00 135/66 |

(Continued)

*Primary Examiner* — Robert Canfield

(74) *Attorney, Agent, or Firm* — Hemisphere Law, PLLC

(57) ABSTRACT

The present invention discloses a foldable crutch stool, including: a support assembly, including an upper support rod and a lower support rod, which are telescopic; a collapsing assembly; and a stool assembly with an upper end pivoted to a sliding base and a lower end pivoted to a positioning base via collapsible rods, wherein a bottom surface of a lower end of the stool assembly is provided with first snap-fit portions, the positioning base is provided with a connector which is provided with second snap-fit portions, and when the stool assembly is folded, the first snap-fit portions are snap-fitted with the second snap-fit portions.

10 Claims, 9 Drawing Sheets

(56) References Cited

U.S. PATENT DOCUMENTS

| | | | | |
|---|---|---|---|---|
| 2015/0327636 | A1* | 11/2015 | Pao | A45B 5/00 135/66 |
| 2017/0086542 | A1* | 3/2017 | Pao | A45B 5/00 |
| 2021/0368986 | A1 | 12/2021 | Hu | |
| 2022/0053939 | A1 | 2/2022 | Leng | |
| 2022/0061535 | A1* | 3/2022 | Pao | A47C 9/105 |
| 2022/0240682 | A1* | 8/2022 | Pao | A45B 5/00 |
| 2023/0054295 | A1 | 2/2023 | You et al. | |
| 2024/0008606 | A1* | 1/2024 | Pao | A47C 9/10 |
| 2024/0041217 | A1* | 2/2024 | Pao | A47C 9/105 |

* cited by examiner

FOLDABLE CRUTCH STOOL

BACKGROUND OF THE INVENTION

Technical Field

The present invention relates to the technical field of crutch stools, and in particular to a foldable crutch stool.

Description of Related Art

In the related art, a crutch stool generally includes a support rod and a foldable stool assembly connected to the support rod via a positioning base and a sliding base. However, when the stool assembly is folded, the connection between the stool assembly and the support rod or the positioning base is not steady, such that the stool assembly in the folded state is still likely to be unfolded accidentally, which affects the user's use experience. Furthermore, the accidental unfolding of the stool assembly is likely to cause accidents, resulting in a potential safety hazard.

Therefore, it is necessary to make improvements to the prior art.

BRIEF SUMMARY OF THE INVENTION

The present invention is intended to solve one of the problems existing in the related art to some extent. To this end, the present invention provides a foldable crutch stool, with a stool assembly that has a reliable connection with a positioning base when in a folded state and is unlikely to be unfolded accidentally.

The above object is achieved by technical solutions as follows: a foldable crutch stool, including: a support assembly, including an axially disposed support rod, wherein the support rod includes an upper support rod and a lower support rod, the lower support rod is provided with a first regulating hole close to an upper end of the lower support rod, and the upper support rod is vertically movably disposed in the lower support rod, and is provided with several second regulating holes mated with the first regulating hole; a connecting member sleeved outside the lower support rod for connecting the first regulating hole and the second regulating hole corresponding thereto in position, together; a handle assembly disposed on a top of the upper support rod; a collapsing assembly, including a positioning base, a sliding base and collapsible rods, wherein the positioning base is sleeved on the lower support rod, and the sliding base is axially slidably sleeved on the lower support rod and above the positioning base; and a stool assembly with an upper end pivoted to the sliding base and a lower end pivoted to the positioning base via the collapsible rods, wherein a bottom surface of a lower end of the stool assembly is provided with first snap-fit portions, the positioning base is provided with a connector which is provided with second snap-fit portions, and when the stool assembly is folded, the first snap-fit portions are snap-fitted with the second snap-fit portions.

In some embodiments, the stool assembly includes a middle seat plate and side seat plates disposed on both sides of the middle seat plate, the side seat plates are connected to the middle seat plate in a foldable way, and bottom surfaces on lower ends of the middle seat plate and the side seat plates are provided with the first snap-fit portions.

In some embodiments, the connector is provided with three second snap-fit portions to correspondingly mate three first snap-fit portions on the stool assembly.

In some embodiments, the connector is axially slidably sleeved on the lower support rod and between the positioning base and the sliding base, the connector is provided with connecting rods connected to the positioning base, and springs are sleeved outside the connecting rods and sandwiched between the connector and the positioning base.

In some embodiments, two connecting rods are provided and located on either side of the connector respectively, and lower ends of the connecting rods are provided with hooks for connection with the positioning base.

In some embodiments, the positioning base is provided with a connecting base at bottom, a lower end of the stool assembly is pivoted to the connecting base via the collapsible rods.

In some embodiments, the connecting member includes an elastic snap ring and a connecting pin disposed on an inner side of the elastic snap ring, the elastic snap ring is sleevable outside the lower support rod, the connecting pin is inserted into the first regulating hole and the corresponding second regulating hole, and the elastic snap ring is provided with a press portion.

In some embodiments, the lower support rod and the upper support rod are both polygonal in cross section, the handle assembly is 7-shaped and includes a transversely disposed hand gripping portion and a connecting portion extending from a bottom of the hand gripping portion, the connecting portion is inserted into the upper support rod to achieve connection, a peripheral surface of the connecting portion is provided with reinforcing ribs that are circumferentially distributed at interval, and the reinforcing ribs are axially arranged.

In some embodiments, a decorative ring is sleeved on a top of the lower support rod, and the upper support rod is inserted into the decorative ring.

In some embodiments, the lower support rod is provided with at least two foldable support legs, which are provided with anti-skid pads at bottom.

Compared with the prior art, the present invention has at least the following beneficial effects: 1. according to the foldable crutch stool provided by the present invention, the stool assembly in a folded state is reliably connected to the positioning base, such that the stool assembly in the folded state is unlikely to be unfolded accidentally, which can improve the users' use experience, avoid accidents caused by accidentally unfolding the stool assembly, and facilitate improvement of product safety; and 2. the foldable crutch stool provided by the present invention is adjustable in height and convenient to operate and use.

DETAILED DESCRIPTION OF THE INVENTION

The present invention is explained in the embodiments below, but is not limited by these embodiments. The modifications to the specific embodiments of the present invention and the equivalent substitution of some of the technical features shall be included within the scope of the technical solutions claimed by the present invention.

Figure 1:
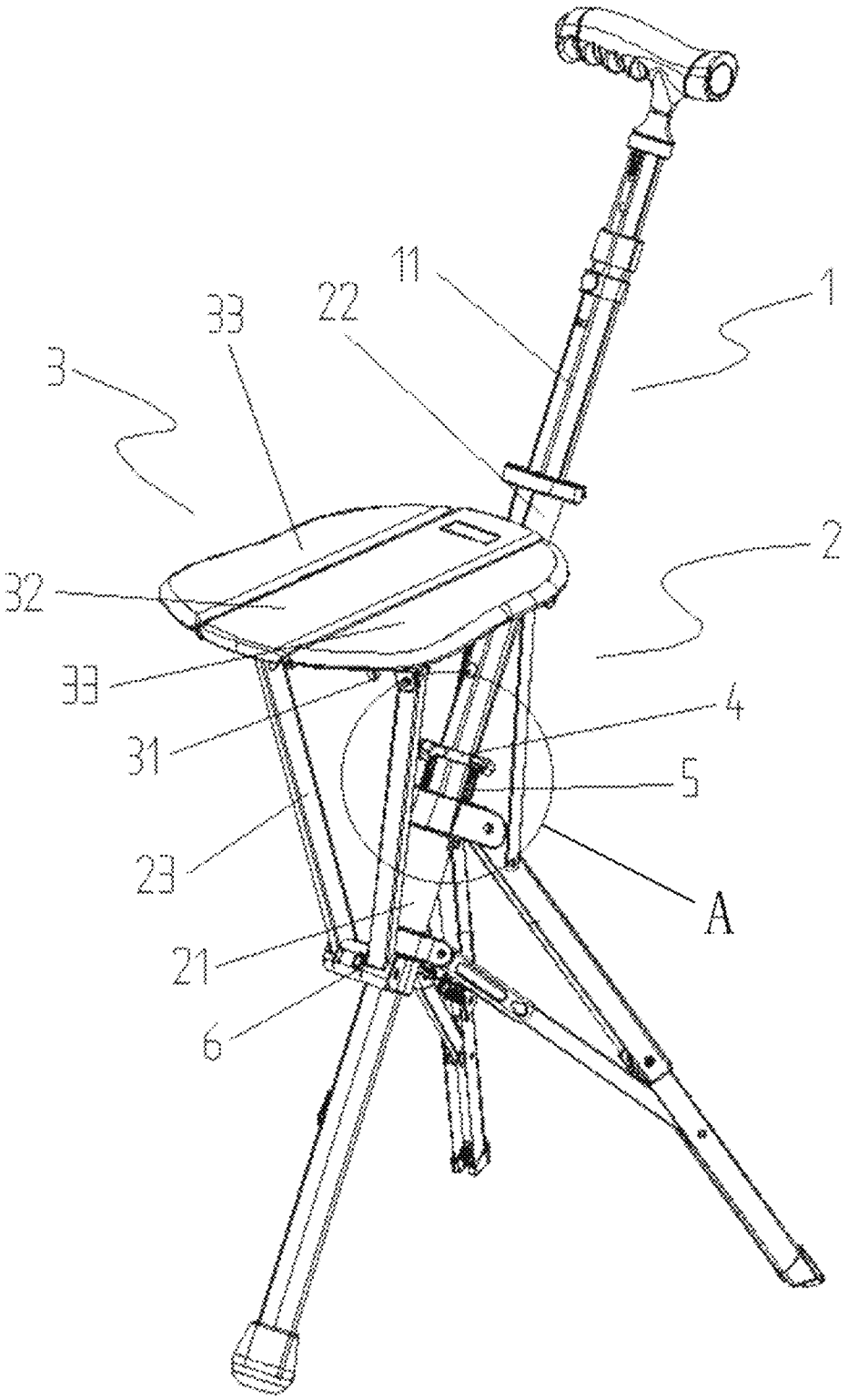
FIG. 1 is a first schematic stereoscopic view of a crutch stool in an unfolded state according to an embodiment.
Figure 2:
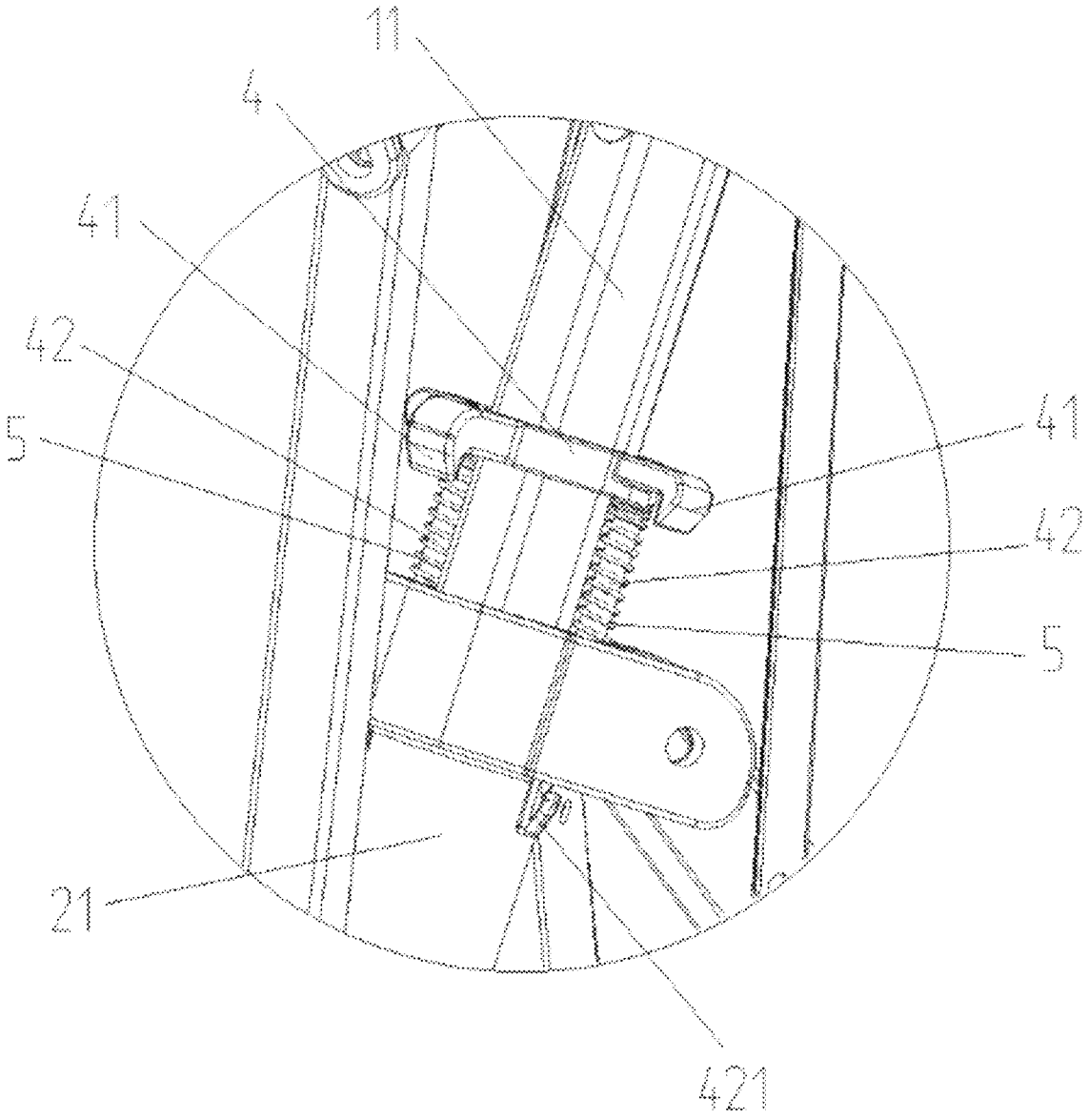
FIG. 2 is a partially enlarged view of a section A in FIG. 2.
Figure 3:
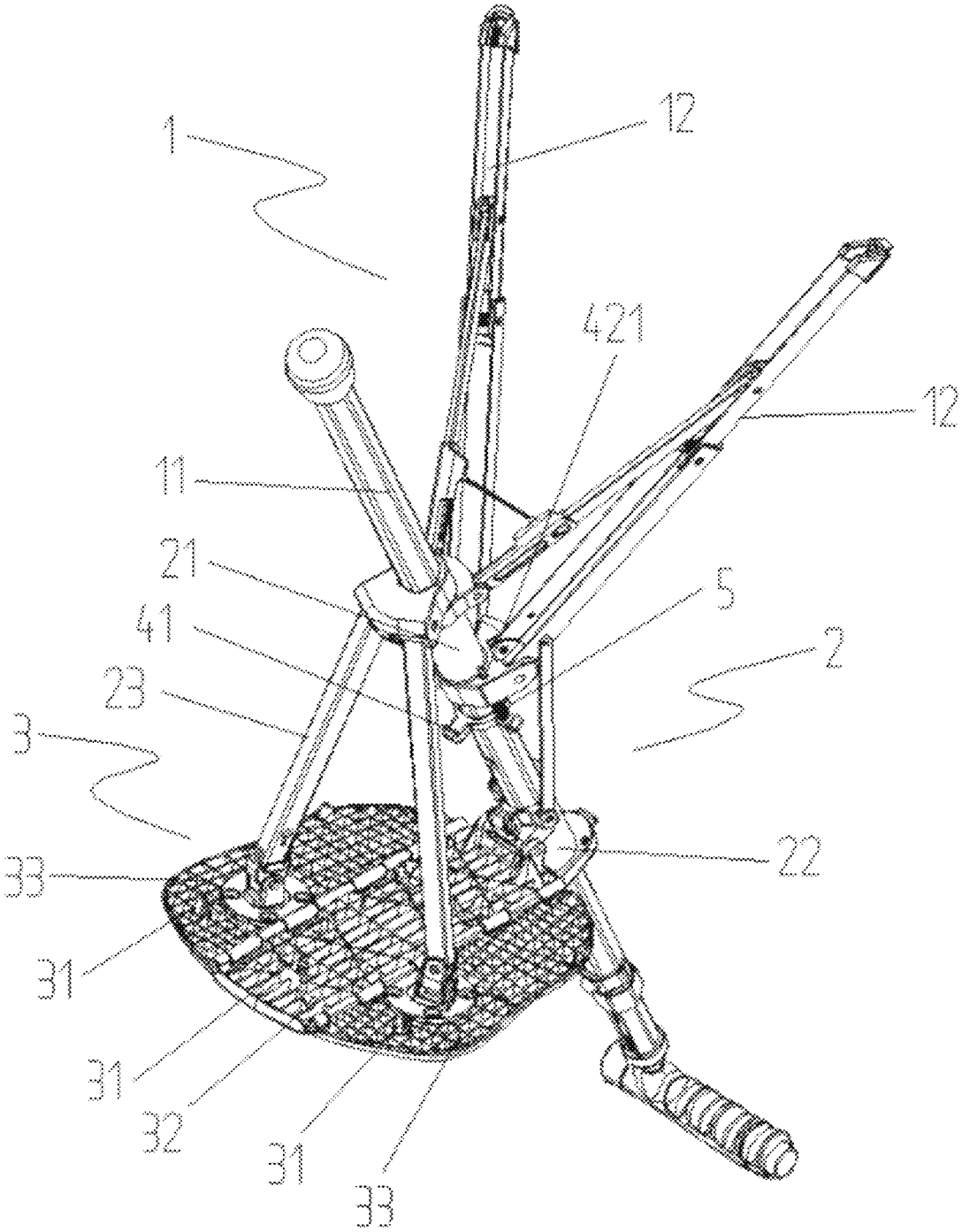
FIG. 3 is a second schematic stereoscopic view of the crutch stool in the unfolded state according to an embodiment.
Figure 4:
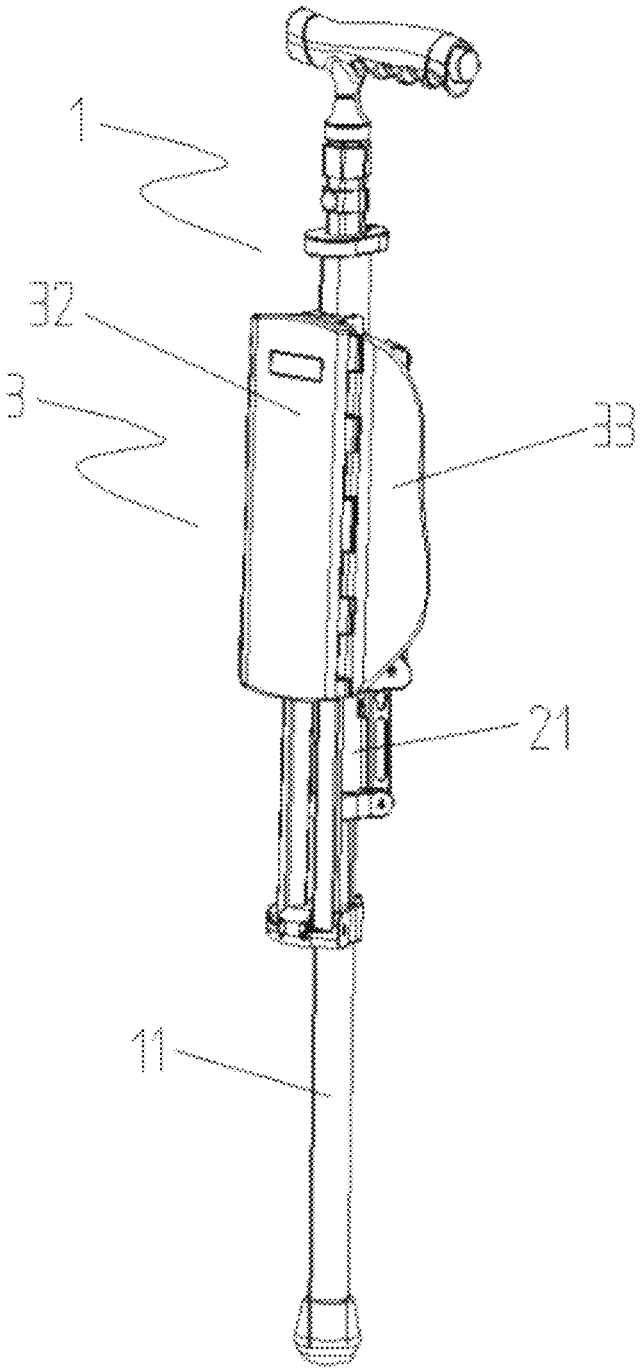
FIG. 4 is a schematic stereoscopic view of the crutch stool in a folded state according to an embodiment.
Figure 5:
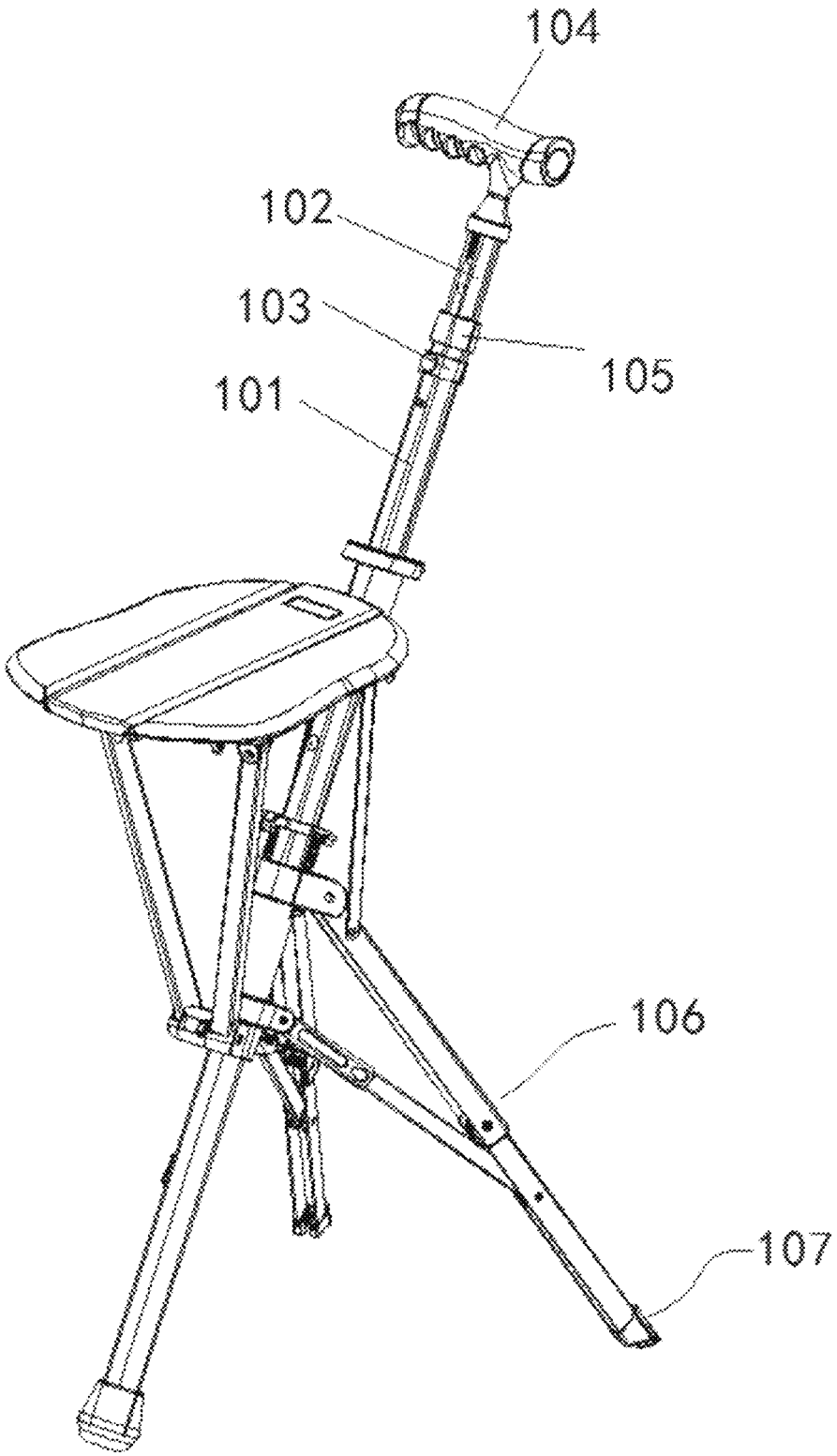
FIG. 5 is a schematic stereoscopic view of the crutch stool according to an embodiment.
Figure 6:
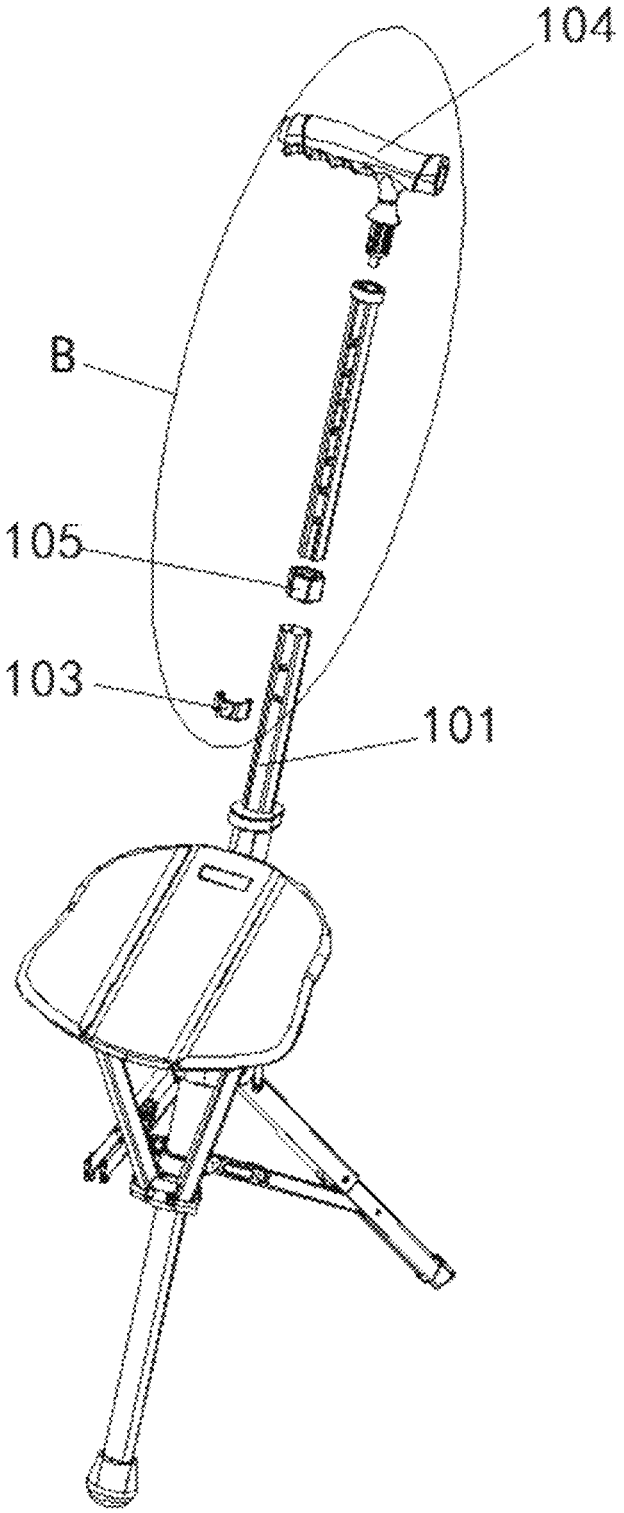
FIG. 6 is a partially exploded view of the crutch stool according to an embodiment.
Figure 7:
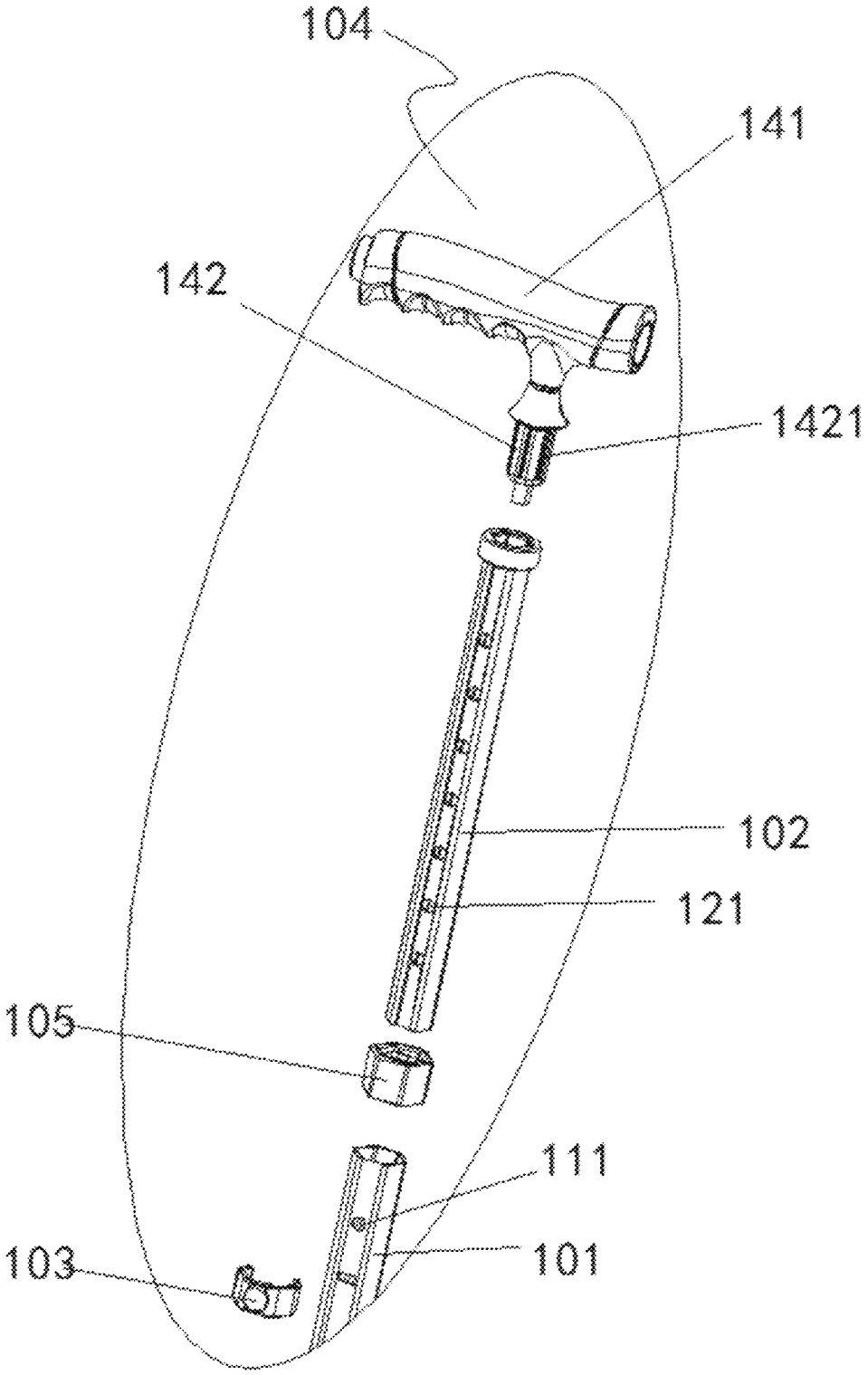
FIG. 7 is a partially enlarged view of a section B in FIG. 6.
Figure 8:
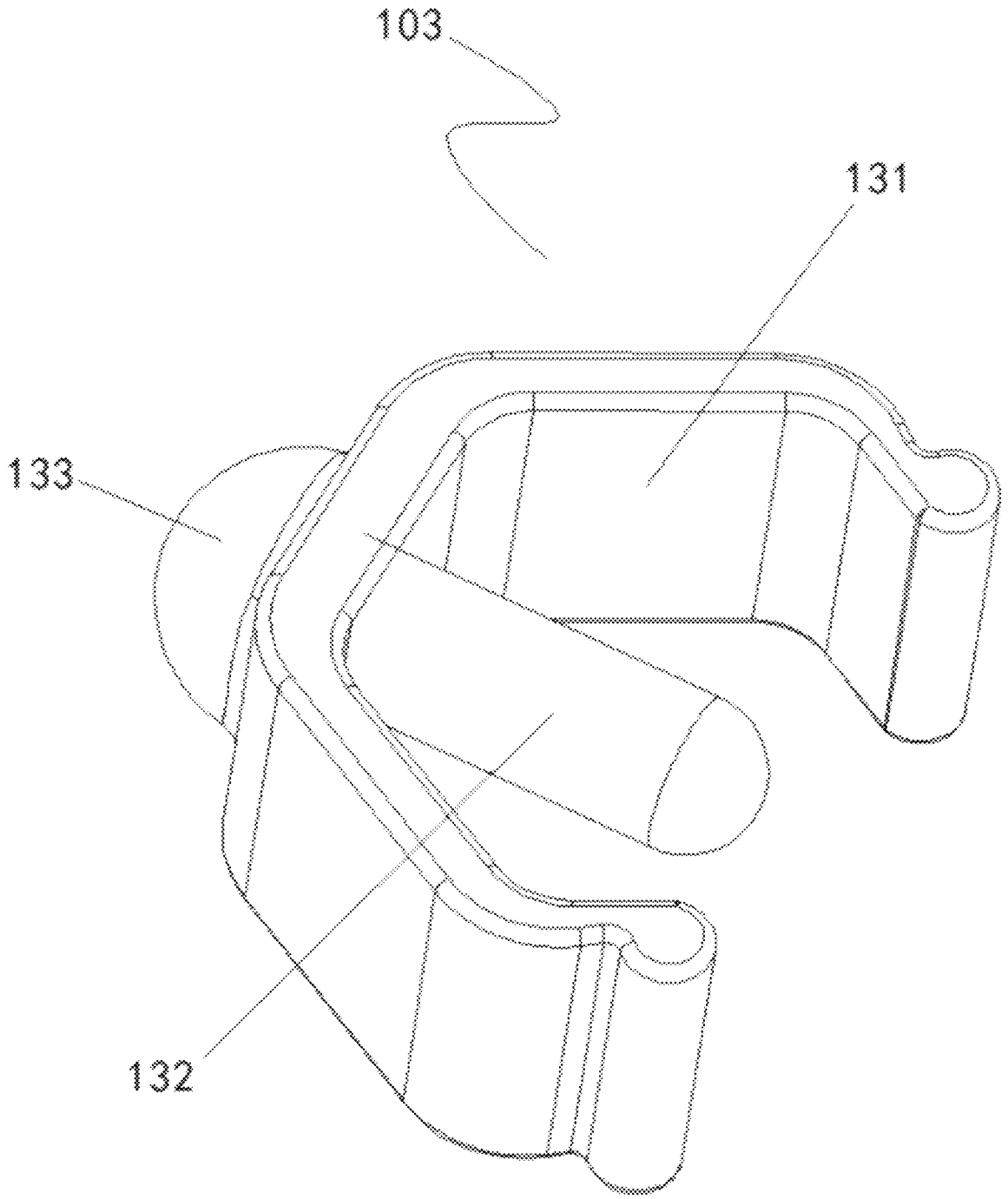
FIG. 8 is a schematic stereoscopic view of a connecting member according to an embodiment.
Figure 9:
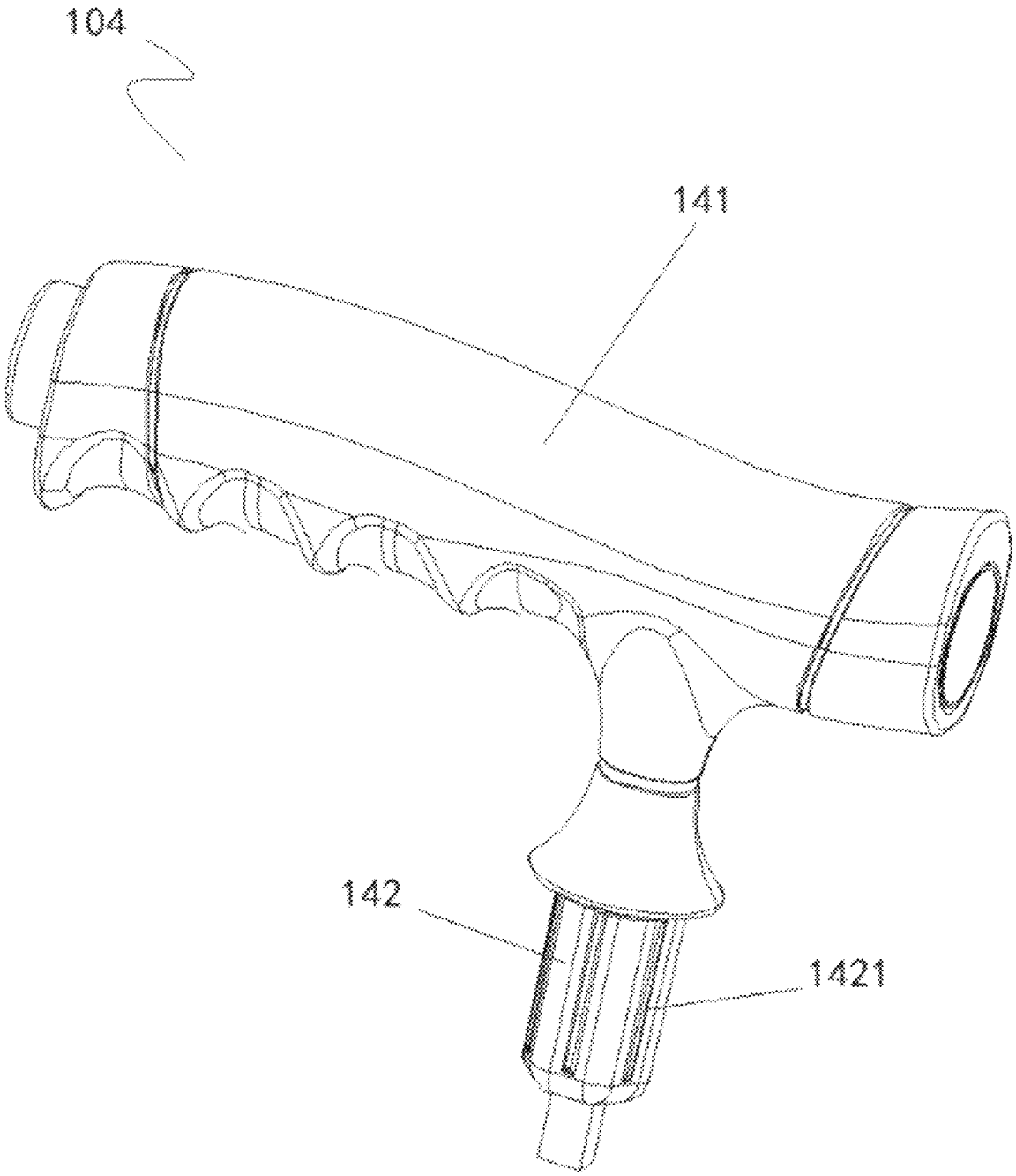
FIG. 9 is a schematic stereoscopic view of a handle assembly according to an embodiment.

Embodiment I: As shown in FIGS. 1, 2, 3, 4, 5, 6, 7, 8 and 9, this embodiment provides a foldable crutch stool, which includes: a support assembly 1, including an axially disposed support rod 11, wherein the support rod 11 includes an upper support rod 102 and a lower support rod 101, the lower support rod 101 is provided with a first regulating hole 111 close to an upper end of the lower support rod, and the upper support rod 102 is vertically movably disposed in the lower support rod 101, and is provided with several second regulating holes 121 mated with the first regulating hole; a connecting member 103 sleeved outside the lower support rod 101 for connecting the first regulating hole 111 and the second regulating hole 121 corresponding thereto in position, together; a handle assembly 104 disposed on a top of the upper support rod 102; a collapsing assembly 2, including a positioning base 21, a sliding base 22 and collapsible rods 23, wherein the positioning base 21 is sleeved on the lower support rod 101, and the sliding base 22 is axially slidably sleeved on the lower support rod 101 and above the positioning base 21; and a stool assembly 3 with an upper end pivoted to the sliding base 22 and a lower end pivoted to the positioning base 21 via the collapsible rods 23, wherein a bottom surface of a lower end of the stool assembly 3 is provided with first snap-fit portions 31, the positioning base 21 is provided with a connector 4 which is provided with second snap-fit portions 41, and when the stool assembly 3 is folded, the first snap-fit portions 31 are snap-fitted with the second snap-fit portions 41.

According to the foldable crutch stool provided by the present invention, the stool assembly 3 in a folded state is reliably connected to the positioning base, such that the stool assembly 3 in the folded state is unlikely to be unfolded accidentally, which can improve the users' use experience, avoid accidents caused by accidentally unfolding the stool assembly 3, and facilitate improvement of safety. Meanwhile, the foldable crutch stool is adjustable in height, which can thus meet the use requirements of more different users to some extent, presenting a wider range of application.

In this embodiment, the stool assembly 3 includes a middle seat plate 32 and side seat plates 33 disposed on both sides of the middle seat plate 32, the side seat plates 33 are connected to the middle seat plate 32 in a foldable way, and the bottom surfaces on lower ends of the middle seat plate 32 and the side seat plates 33 are provided with the first snap-fit portions 31.

In this way, with the middle seat plate 32 and the side seat plates 33 on both sides, the folded stool assembly 3 can achieve an extremely small footprint, and can be substantially packaged outside the support rod 11, which facilitates storage and carrying by a user. Furthermore, the bottom surfaces on the lower ends of the middle seat plate 32 and the side seat plates 33 are provided with the first snap-fit portions 31. That is, each seat plate can be connected to the connector 4, which further improves the reliability of connection between the folded stool assembly 3 and the positioning base 21.

Meanwhile, in this embodiment, the support assembly 1 is adjustable in structural height and relatively convenient to operate and use. Specifically, when the lower support rod 101 and the upper support rod 102 need to be connected together, the connecting member 103 is sleeved outside the lower support rod 101, and the first regulating hole 111 and the second regulating hole 121 corresponding to the first regulating hole in position are connected together via the connecting member 103, thereby achieving connection between the lower support rod 101 and the upper support rod 102. When the height of the support assembly 1 needs to be regulated again, the connecting member 103 is removed from the lower support rod 101, the first regulating hole 111 and the second regulating hole 121 corresponding to the first regulating hole in position are disconnected by means of the connecting member 103, in which case the upper support rod 102 can move vertically inside the lower support rod 101, and when the upper support rod 102 moves to an appropriate position, the operation of connecting the lower support rod 101 and the upper support rod 102 is repeated.

In this embodiment, the connecting member 103 includes an elastic snap ring 131 and a connecting pin 132 disposed on an inner side of the elastic snap ring 131, the elastic snap ring 131 is sleevable outside the lower support rod 101, and the connecting pin 132 is inserted into the first regulating hole 111 and the corresponding second regulating hole 121. In this way, the connecting member 103 is simple in structure and low in cost, which facilitates batch production and market popularization. Meanwhile, the connecting member 103 is reasonable and ingenious in structure, by which the connection between the lower support rod 101 and the upper support rod 102 can be achieved, thereby achieving better convenience in operation and use.

In this embodiment, the elastic snap ring 131 is provided with a press portion 133. In this way, the convenience in installation and use of the connecting member 103 can be improved.

Further, the connector 4 is provided with three second snap-fit portions 41 to correspondingly mate three first snap-fit portions 31 on the stool assembly 3, exhibiting a simple structure and a skillful design. That is, the connector 4 can be connected to each seat plate, such that the reliability in connection of the stool assembly 3 in the folded state can be improved.

More further, the connector 4 is axially slidably sleeved on the support rod 11 and between the positioning base 21 and the sliding base 22, the connector 4 is provided with connecting rods 42 connected to the positioning base 21, and springs 5 are sleeved outside the connecting rods 42 and sandwiched between the connector 4 and the positioning base 21. In this way, the structure is simple, and the design is reasonable and skillful, which facilitate the implementation of folding and unfolding of the crutch stool. Of course, a switching mechanism can be provided to implement the folding and unfolding of the crutch stool, which, however, pertains to an existing design and will not be described in detail.

In this embodiment, two connecting rods 42 are provided and located on either side of the connector 4 respectively, and the lower ends of the connecting rods 42 are provided with hooks 421 for connection with the positioning base 21. In this way, the structure is simple, and the design is reasonable, which can improve the stability and reliability of connection between the connector 4 and the positioning base 21 to avoid looseness therebetween.

Further, the positioning base 21 is provided with a connecting base 6 at bottom, and the lower end of the stool assembly 3 is pivoted to the connecting base 6 via the collapsible rods 23. In this way, the structure is simple, and the design is reasonable, which facilitate the improvement of stability and reliability of the crutch stool in use.

Further, the lower support rod 101 and the upper support rod 102 are both polygonal in cross section. The polygonal design improves the overall structural strength of the lower support rod 101 and the upper support rod 102, such that the purpose of improving the stability and reliability of the crutch stool is achieved.

More further, the handle assembly 104 is 7-shaped and includes a transversely disposed hand gripping portion 141 and a connecting portion 142 extending from the bottom of the hand gripping portion 141, and the connecting portion 142 is inserted into the upper support rod 102 to achieve their connection. In this way, the handle assembly 104 is simple in structure and reasonable and skillful in design, which facilitates the connection between the handle assembly 104 and the upper support rod 102 as well as the gripping by a user, thereby improving the user's use experience.

In this embodiment, the peripheral surface of the connecting portion 142 is provided with reinforcing ribs 1421 that are circumferentially distributed at interval, and the reinforcing ribs 1421 are axially arranged. In this way, the structure is simple, the design is reasonable, and the reinforcing ribs 1421 enhance the connection between the connecting portion 142 and the upper support rod 102, which improves the stability and reliability in connection and avoids looseness between the two.

Further, a decorative ring 105 is sleeved on the top of the lower support rod 101, and the upper support rod 102 is inserted into the decorative ring 105. With the decorative ring 105 provided, the gap between the lower support rod 101 and the upper support rod 102 can be covered, which endows the crutch stool with an aesthetic appearance to improve the appeal to consumers and market competitiveness for the crutch stool.

More further, the lower support rod 101 is provided with at least two foldable support legs 106, which are provided with anti-skid pads 107 at bottom. In this way, the structure is simple, and the foldable crutch stool in an unfolded state can be better supported on the ground by means of the support legs 106, such that the sitting stability is improved for a user. Moreover, the support legs 106 have a foldable design, by which the folded crutch stool is smear in footprint to facilitate storage and carrying by the user after folding. Moreover, with the design of the anti-skid pads 107, the anti-skid property of the crutch stool can be improved to prevent a user from slippage and falling when he/she is sitting on the crutch stool.

Described above are only some embodiments of the present invention. For those of ordinary skill in the art, several variations and improvements can also be made without departing from the inventive concept of the present invention, and these variations and improvements shall be construed as falling within the protection scope of the present invention.

What is claimed is:

1. A foldable crutch stool, comprising:

a support assembly (1), comprising an axially disposed support rod (11), wherein the support rod (11) comprises an upper support re (101 upper support rod (102) and lower support rod (101), an upper end of the lower support rod (101) is provided with a first regulating hole (111), and the upper support rod (102) is vertically movably disposed in the lower support rod (101), and is provided with several second regulating holes (121) adapted to align with the first regulating hole;

a connecting member (103) sleeved outside the lower support rod (101) for connecting the first regulating hole (111) and a corresponding second regulating hole (121) corresponding thereto in position, together;

a handle assembly (104) disposed on a top of the upper support rod (102);

a collapsing assembly (2), comprising a positioning base (21), a sliding base (22) and collapsible rods (23), wherein the positioning base (21) is sleeved on the lower support rod (101), and the sliding base (22) is axially slidably sleeved on the lower support rod (101) and above the positioning base (21); and a stool assembly (3) with an upper end pivoted to the sliding base (22) and a lower end pivoted to the positioning base (21) via the collapsible rods (23), wherein a bottom surface of a lower end of the stool assembly (3) is provided with first snap-fit portions (31), the positioning base (21) is provided with a connector (4) which is provided with second snap-fit portions (41), and when the stool assembly (3) is folded, the first snap-fit portions (31) are snap-fitted with the second snap-fit portions (41).

2. The foldable crutch stool according to claim 1, wherein the stool assembly (3) comprises a middle seat plate (32) and side seat plates (33) disposed on both sides of the middle seat plate (32), the side seat plates (33) are connected to the middle seat plate (32) in a foldable way, and bottom surfaces on lower ends of the middle seat plate (32) and the side seat plates (33) are provided with the first snap-fit portions (31).

3. The foldable crutch stool according to claim 2, wherein the connector (4) is provided with three second snap-fit portions (41) to correspondingly mate three first snap-fit portions (31) on the stool assembly (3).

4. The foldable crutch stool according to claim 1, wherein the connector (4) is axially slidably sleeved on the lower support rod (101) and between the positioning base (21) and the sliding base (22), the connector (4) is provided with connecting rods (42) connected to the positioning base (21), and springs (5) are sleeved outside the connecting rods (42) and sandwiched between the connector (4) and the positioning base (21).

5. The foldable crutch stool according to claim 4, wherein two connecting rods (42) are provided and located on either side of the connector (4) respectively, and lower ends of the connecting rods (42) are provided with hooks (421) for connection with the positioning base (21).

6. The foldable crutch stool according to claim 1, wherein the positioning base (21) is provided with a connecting base (6) at bottom, a lower end of the stool assembly (3) is pivoted to the connecting base (6) via the collapsible rods (23).

7. The foldable crutch stool according to claim 1, wherein the connecting member (103) comprises an elastic snap ring (131) and a connecting pin (132) disposed on an inner side of the elastic snap ring (131), the elastic snap ring (131) is sleevable outside the lower support rod (101), the connecting pin (132) is inserted into the first regulating hole (101) and the corresponding second regulating hole (121), and the elastic snap ring (131) is provided with a press portion (133).

8. The foldable crutch stool according to claim 1, wherein the lower support rod (101) and the upper support rod (102) are both polygonal in cross section, the handle assembly (104) is 7-shaped and comprises a transversely disposed hand gripping portion (141) and a connecting portion (142) extending from a bottom of the hand gripping portion (141), the connecting portion (142) is inserted into the upper support rod (102) to achieve connection, a peripheral surface of the connecting portion (142) is provided with reinforcing ribs (1421) that are circumferentially distributed at interval, and the reinforcing ribs (1421) are axially arranged.

9. The foldable crutch stool according to claim 1, wherein a decorative ring (105) is sleeved on a top of the lower support rod (101), and the upper support rod (102) is inserted into the decorative ring (105).

10. The foldable crutch stool according to claim 1, wherein the lower support rod (101) is provided with at least two foldable support legs (106), which are provided with anti-skid pads (107) at bottom.

* * * * *